United States Patent [19]

Johnson et al.

[11] Patent Number: 4,840,722

[45] Date of Patent: Jun. 20, 1989

[54] NON-CATALYTIC PROCESS FOR THE CONVERSION OF A HYDROCARBONACEOUS STREAM CONTAINING HALOGENATED ORGANIC COMPOUNDS

[75] Inventors: Russell W. Johnson, Elmhurst; Lee Hilfman, Mount Prospect, both of Ill.

[73] Assignee: UOP, Des Plaines, Ill.

[21] Appl. No.: 176,504

[22] Filed: Apr. 1, 1988

[51] Int. Cl.[4] ..... C10G 45/02; C10G 67/10

[52] U.S. Cl. ..... 208/95; 208/107; 208/142; 208/262.1; 208/262.5; 585/841

[58] Field of Search ..... 208/262, 107, 95, 262.1, 208/262.5; 585/469, 841

[56] References Cited

U.S. PATENT DOCUMENTS

| | | | |
|---|---|---|---|
| 3,595,931 | 7/1971 | Hay et al. | 260/668 |
| 3,892,818 | 7/1975 | Scharfe et al. | 260/676 |
| 3,919,398 | 11/1975 | Davis | 423/481 |
| 4,201,665 | 5/1980 | Savage et al. | 210/32 |
| 4,284,516 | 8/1981 | Parker et al. | 585/469 |
| 4,351,978 | 9/1982 | Hatano et al. | 585/469 |
| 4,379,746 | 4/1983 | Norman et al. | 208/262 |
| 4,578,194 | 3/1986 | Reinartz et al. | 210/673 |
| 4,639,309 | 1/1987 | Lalancette et al. | 585/469 |
| 4,755,628 | 7/1988 | Adams | 208/262 |

OTHER PUBLICATIONS

Kirk-Othmer, *Encyclopedia of Chemical Technology*, Third Edition, vol. 12, p. 999.

*Primary Examiner*—Anthony McFarlane

*Attorney, Agent, or Firm*—Thomas K. McBride; John G. Tolomei; John G. Cutts, Jr.

[57] ABSTRACT

A non-catalytic process for the conversion of a hydrocarbonaceous stream containing less than about 5 weight percent halogenated organic compounds which process comprises: (a) reacting the hydrocarbonaceous stream in the presence of hydrogen in a reaction zone at reaction conditions including an elevated temperature selected to convert at least a portion of the halogenated organic compounds to more highly hydrogenated organic compounds; and (b) recovering a hydrocarbonaceous product stream containing lower halogen content.

10 Claims, 1 Drawing Sheet

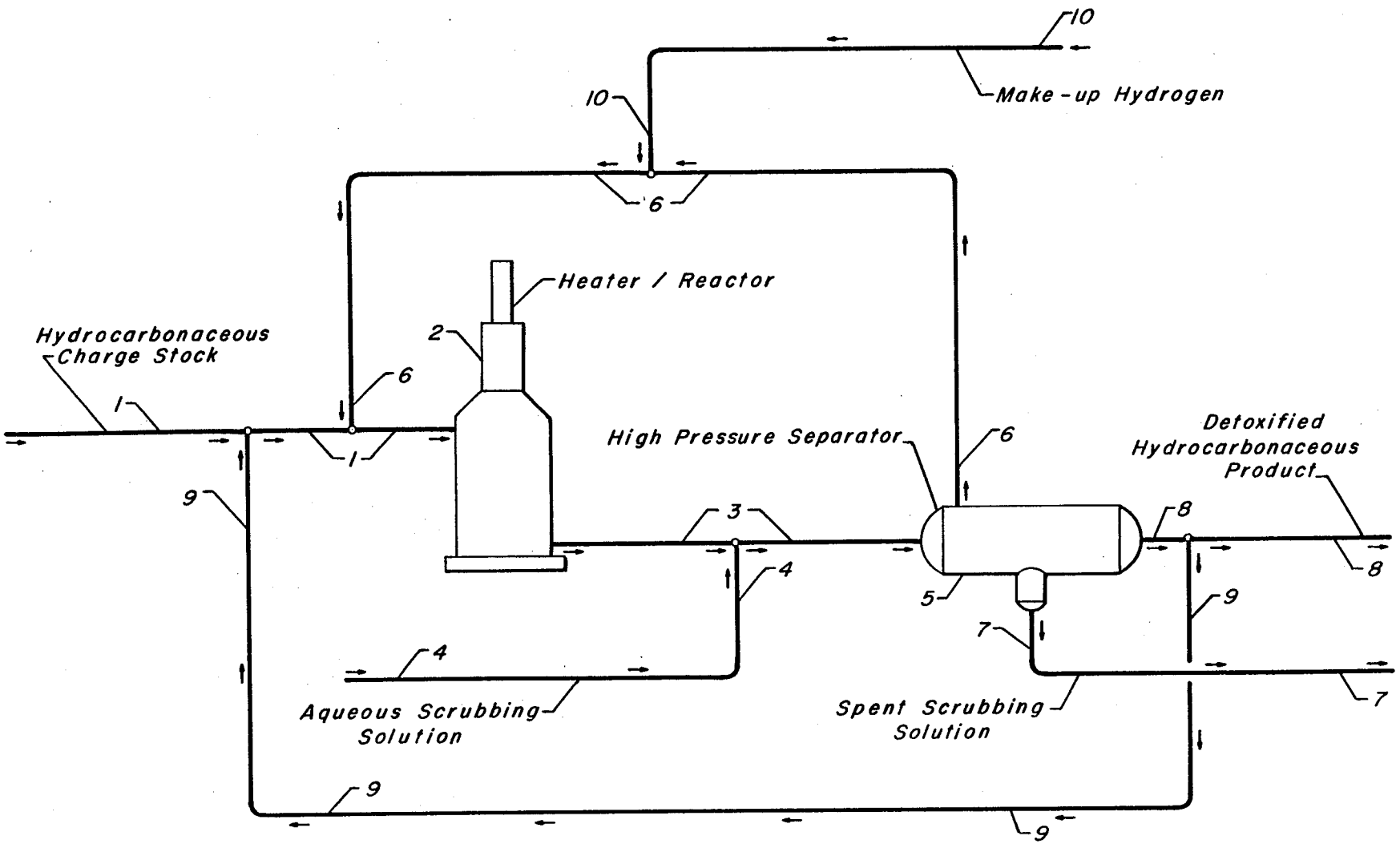
Make-up Hydrogen
Detoxified Hydrocarbonaceous Product
Spent Scrubbing Solution
High Pressure Separator
Heater / Reactor
Aqueous Scrubbing Solution
Hydrocarbonaceous Charge Stock
10
8
7
9
6
5
4
3
2
1

NON-CATALYTIC PROCESS FOR THE CONVERSION OF A HYDROCARBONACEOUS STREAM CONTAINING HALOGENATED ORGANIC COMPOUNDS

BACKGROUND OF THE INVENTION

The field of art to which this invention pertains is the conversion of a hydrocarbonaceous stream containing less than about 5 weight percent halogenated organic compounds. More particularly, the invention relates to the non-catalytic conversion of hydrogenated organic compounds to more highly hydrogenated organic compounds by contacting the hydrocarbonaceous stream with hydrogen in a reaction zone at reaction conditions including an elevated temperature selected to effect the desired conversion. More specifically, the invention relates to a non-catalytic process for the conversion of a hydrocarbonaceous stream containing less than about 5 weight percent halogenated organic compounds which process comprises: (a) reacting the hydrocarbonaceous stream in the presence of hydrogen in a reaction zone at reaction conditions including an elevated temperature selected to convert at least a portion of the halogenated organic compounds to more highly hydrogenated organic compounds; and (b) recovering a hydrocarbonaceous product stream containing lower halogen content.

INFORMATION DISCLOSURE

In U.S. Pat. No. 3,919,398 (Davis), a method is disclosed for recovering bromine as hydrogen bromide from aromatic bromides. The method involves reacting the aromatic bromide with hydrogen at a temperature within the range from about 200° to about 600° C. in the presence of a palladium activated catalyst.

In U.S. Pat. No. 3,892,818 (Scharfe et al.), a method is disclosed for the conversion of hydrocarbon chlorides in the presence of hydrogen to hydrocarbons and hydrogen chloride wherein the process takes place in a gaseous phase and in the presence of a rhodium-containing catalyst.

In U.S. Pat. No. 4,201,665 (Savage et al.), a method is disclosed for the use of nonstoichiometric carbon-sulfur compounds to remove a wide variety of organic and/or inorganic materials from liquids. The '665 patent teaches that the removal of biorefractory organics, such as aromatics, is particularly effective and that the spent adsorbent may then be regenerated. The '665 patent also teaches that organic components subject to removal include, but are not limited to, aromatic compounds, aliphatic compounds, phenolic compounds, organic acids, alcohols, esters, aldehydes, amines, pyridines, morpholines, esters, glycols, glycol ethers, halogenated hydrocarbons, ketones, oxides, vinyl chloride and the like.

In U.S. Pat. No. 3,595,931 (Hay et al.), a process is disclosed to replace the halogen moiety on a halogenated aromatic with hydrogen by contacting the halogenated aromatic in the vapor phase in the presence of hydrogen with a supported catalyst containing a minor amount of platinum or palladium and a minor amount of a hydrated alkali or alkaline earth metal oxide such as potassium hydroxide.

In Kirk, Othmer, Encyclopedia of Chemical Technology, Third Edition, Volume 12, at page 999, a method is described to remove hydrogen chloride by scrubbing a gaseous mixture with water.

In U.S. Pat. No. 4,578,194 (Reinartz et al.), a process is disclosed for the removal of polychlorinated biphenyls (PCB) from transformerinsulating liquids using an adsorption resin. The insulating liquid is passed through the adsorption resin and after enrichment with PCB oil, the resin is washed with a solvent for PCB oils in order to regenerate the resin for reuse.

BRIEF SUMMARY OF THE INVENTION

The invention provides a non-catalytic process for the conversion of a hydrocarbonaceous stream containing less than about 5 weight percent halogenated organic compounds by contacting the hydrocarbonaceous stream with hydrogen at elevated temperatures in order to hydrothermally convert at least a portion of the halogenated organic compounds to more highly hydrogenated organic compounds. The present invention also contemplates the recycle of at least a portion of the resulting converted hydrocarbonaceous product to the non-catalytic hydrothermal treatment section in order to enhance the conversion of the fresh hydrocarbonaceous stream charge stock.

One broad embodiment of the invention may be characterized as a non-catalytic process for the conversion of a hdyrocarbonaceous stream containing less than about 5 weight percent halogenated organic compounds which process comprises: (a) reacting the hydrocarbonaceous stream in the presence of hydrogen in a reaction zone at reaction conditions including an elevated temperature selected to convert at least a portion of the halogenated organic compounds to more highly hydrogenated organic compounds; and (b) recovering a hydrocarbonaceous product stream containing lower halogen content.

Another embodiment of the invention may be characterized as a non-catalytic process for the conversion of a hydrocarbonaceous stream containing less than about 5 weight percent halogenated organic compounds which process comprises: (a) reacting the hydrocarbonaceous stream in the presence of hydrogen in a reaction zone at reaction conditions including an elevated temperature selected to convert at least a portion of the halogenated organic compounds to more highly hydrogenated organic compounds; (b) contacting the reaction zone effluent with an aqueous scrubbing solution; and (c) introducing a resulting admixture of the reaction zone effluent and the aqueous scrubbing solution into a separation zone to provide a hydrocarbonaceous product stream containing lower halogen content and a spent aqueous stream.

Other embodiments of the subject invention encompass further details such as hydrocarbonaceous charge stocks, aqueous scrubbing solutions, and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

There is a steadily increasing demand for technology which is capable of converting or detoxifying halogenated organic compounds and particularly where these halogenated organic compounds are in admixture with a hydrocarbonaceous stream. In many instances, toxic halogenated organic compounds must be reduced or eliminated before a hydrocarbonaceous stream may be utilized or properly discarded. In the event that the halogenated organic compounds are toxic, carcinogenic or otherwise obnoxious, it is preferred that the halogenated organic compounds not only be removed from the hydrocarbonaceous stream but converted into less noxious compounds. Therefore, those skilled in the art have sought to find feasible techniques to convert and detoxify halogenated organic compounds in order to thereby detoxify a hydrocarbonaceous stream containing the halogenated organic compounds.

It is well known that the art broadly teaches that organic compounds may be adsorbed from a hdyrocarbonaceous stream by contacting the hydrocarbonaceous stream with an adsorbent and subsequently regenerating the spent adsorbent with an elution solvent. Furthermore, it is known that a halogenated aromatic compound may be hydrogenated in the presence of a hydrogenation or hydrotreating catalyst and that hydrogen chloride may be scrubbed from a gaseous admixture comprising hydrogen chloride with water.

Waste disposal from the chemical, agricultural and other industries is a serious problem which is being more intensely studied. In particular, there are many chemical wastes such as various halogenated hydrocarbons which are not biodegradable, and thus must either be stored in secure, specialized areas or otherwise converted into less hazardous substances. One method for conversion has been the incineration of the hazardous streams in specially-designed reactors. Incineration is an effective and proven technique for the conversion of toxic wastes, however, in the case where the actual toxic compounds comprise only a small percentage of the total hazardous stream, the incineration of the entire stream simultaneously destroys the advantageous utilization of the innocuous portion in any other manner which is often seen as a waste of resources. The objection to total destruction of a hazardous waste stream during incineration is obviated by the catalytic hydrogenation of toxic components contained in a hydrocarbonaceous stream to yield a detoxified hydrocarbonaceous stream which may be utilized elsewhere. Unfortunately, some hydrocarbonaceous hazardous waste streams contain certain components such as, for example, metals, ash, heavy polymers, and organometallic compounds which can have deleterious effects on catalysts and the smooth uniterrupted operation of a catalytic hydrogenation process. Metals are known hydrogenation catalyst poisons, and ash and coke precursors can rapidly create plugging of fixed catalyst beds which precludes further processing until remedial measures are taken.

In an attempt to find new ways to process hydrocarbonaceous waste streams containing halogenated organic compounds which are difficult, if not impossible, to readily detoxify in a catalytic hydrogenation process, we have discovered a non-catalytic process for the conversion of a hydrocarbonaceous stream containing less than about 5 weight percent halogenated organic compounds by contacting the hydrocarbonaceous stream with hydrogen in a reaction zone at reaction conditions including an elevated temperature selected to effect the conversion of the halogenated organic compounds.

The present invention provides an improved and novel process for the conversion of a hydrocarbonaceous stream containing less than about 5 weight percent halogenated organic compounds. A wide variety of halogenated hydrocarbonaceous compounds are to be considered candidates for conversion in a hydrocarbonaceous stream in accordance with the process of the present invention. Certain halogenated hydrocarbons having demonstrated or potential toxicity include but are not limited to kepone, halogenated biphenyls, halogenated cyclodienes, such as aldrin, dialdrin, and hexachlorocyclopentadienes, dibromochloropropane, halogenated phthalic anhydrides, such as polybromophthalicanhydride, tetrachloroethylene, tetrachloroethane, polychlorodioxins such as tetrachlorodibenzodioxin, halogenated organic phosphates such as 2,2 dichlorovinyldimethylphosphate. The hydrocarbonaceous charge stocks which are contemplated for the present process contain halogenated hydrocarbonaceous compounds and may also include organometallic compounds and especially those which contain metals such as lead, mercury, cadmium, cobalt, arsenic, vanadium, and chromium. The charge stock of the present invention may also include polynuclear aromatic compounds and hydrocarbonaceous compounds comprising sulfur, oxygen, metal and nitrogen components.

In accordance with the present invention, a hydrocarbonaceous stream containing less than about 5 weight percent halogenated organic compounds is contacted with hydrogen at reaction conditions including an elevated temperature selected to convert at least a portion of the halogenated organic compounds to more highly hydrogenated organic compounds. The reaction in accordance with the present invention may be conducted in a batchwise process or in a continuously operating process. This reaction zone is preferably maintained under an imposed hydrogen pressure from about 10 psig (68.9 kPa gauge) to about 2000 psig (13790 kPa gauge) and more preferably under a pressure from about 100 psig (689 kPa gauge) to about 1800 psig (12411 kPa gauge). Suitably, such reaction is conducted at a temperature in the range of about 350° F. (177° C.) to about 850° F. (454° C.) selected to perform the desired hydrothermal temperature of the halogenated organic compounds in order to reduce or eliminate the concentration of halogenated organic compounds in the hydrocarbonaceous charge stock. In the event that the process is operated in a continuous manner, further preferred operating conditions include a liquid hourly space velocity in the range from about 0.1 $hr^{-1}$ to about 100 $hr^{-1}$ and hydrogen circulation rates from about 20 standard cubic feet per barrel (SCFB) (3.4 normal $m^3/m^3$) to about 25,000 SCFB (4213 normal $m^3/m^3$), preferably from about 30 SCFB (5.1 normal $m^3/m^3$) to about 8000 SCFB (1348 normal $m^3/m^3$). In the event that the process of the present invention is conducted in a batch-wise system, the required amount of hydrogen will be that required to maintain the desired system pressure and the residence time is preferably from about 1 minute to about 10 hours depending upon the charge stock composition and the level of conversion desired. In the batch operation, the acid gas which is necessarily produced as a product of the reaction is preferably contacted with and neutralized by an aqueous scrubbing solution. Such neutralization techniques may be conducted in any suitable manner known in the art.

In the embodiment of the present invention wherein the process is conducted in a continuous manner, the hydrocarbonaceous effluent from the hydrothermal reaction zone is preferably contacted with an aqueous scrubbing solution and the resulting admixture is admitted to a separation zone in order to separate a spent aqueous scrubbing solution, a converted hydrocabonaceous phase and a hydrogen-rich gaseous phase. The contact of the hydrocarbonaceeous effluent from the hydrothermal reaction zone with the aqueous scrubbing solution may be performed in any convenient manner and is preferably conducted by co-current, in-line mixing which may be promoted by inherent turbulence, mixing orifices or any other suitable mixing means. The aqueous scrubbing solution is preferably introduced in an amount from about 1 to about 40 volume percent based on the hydrocarbonaceous effluent from the hydrothermal reaction zone. The aqueous scrubbing solution is selected depending on the characteristics of the halogenated organic compounds which are converted. Since the hydrogenation and subsequent conversion of the halogenated organic compounds produces an acid gas, the aqueous scrubbing solution preferably contains a basic compound such as calcium hydroxide, potassium hydroxide or sodium hydroxide in order to neutralize the acid which is formed during the hydrogenation of the halogenated organic compounds. The resulting converted hydrocarbonaceous phase is recovered and the hydrogen-rich gaseous phase may be recycled to the hydrothermal reaction zone if desired. In a preferred embodiment of the subject invention, at least a portion of the recovered converted hydrocarbonaceous product is recycled to the hydrothermal reaction zone. A portion of the aqueous scrubbing solution recovered in the separation zone may be recycled to contact the hydrocarbonaceous effluent from the hydrothermal reaction zone. The spent aqueous scrubbing solution may be neutralized or otherwise treated to provide a more environmentally acceptable effluent.

In the drawing, the process of the present invention is illustrated by means of a simplified flow diagram in which such details as pumps, instrumentation, heat exchange and heat-recovery circuits, compressors, surge tanks and similar hardware have been deleted as being non-essential to an understanding of the techniques involved. The use of such miscellaneous appurtenances are well within the purview of one skilled in the art.

With reference now to the drawing, a hdyrocarbonaceous charge stock containing less than about 5 weight percent halogenated organic compounds is introduced into the process via conduit 1 and is admixed with a hereinafter described hydrogen-rich gaseous stream provided via conduit 6 and a hereinafter described detoxified hydrocarbonaceous product recycle stream provided via conduit 9. This resulting admixture is introduced via conduit 1 into heater/reactor 2 wherein the admixture is heated to reaction conditions including an elevated temperature selected to convert at least a portion of the halogenated organic compounds contained in the charge stock to more highly hydrogenated organic compounds. The resulting effluent from heater/reactor 2 is removed via conduit 3 and admixed with an aqueous scrubbing solution provided via conduit 4 and this resulting admixture is introduced via conduit 3 into high pressure separator 5. A hydrogen-rich gaseous phase is removed from high pressure separator 5 via conduit 6 and recycled as hereinabove described. Make-up hydrogen is introduced via conduit 10, conduit 6 and conduit 1 into heater/reactor 2. A detoxified hydrocarbonaceous product stream is removed from high pressure separator 5 via conduit 8 and recovered. A spent scrubbing solution is removed from high pressure separator 5 via conduit 7 and recovered. A portion of the detoxified hydrocarbonaceous product stream is recycled via conduits 8, 9 and 1 to heater/reactor 2 as described hereinabove.

The following examples are presented for the purpose of further illustrating the process of the present invention and to indicate the benefits afforded by the utilization thereof. The examples are not to be construed as an undue limitation on the generally broad scope of the invention as set out in the appended claims and are therefore intended to be illustrative rather than restrictive.

EXAMPLE 1

In this example, a transformer oil containing 5000 ppm 1,1,1-trichloroethane was introduced into an autoclave reaction chamber. The autoclave was maintained at a pressure of 300 psig (2608 kPa gauge) with hydrogen and at a temperature of 500° F. (260° C.) for two hours. After completion of the test, the autoclave was cooled and depressured, and the contents of the autoclave were analyzed. A summary of the results is presented in Table 1.

TABLE 1

SUMMARY OF RESULTS

| | Transfer Oil Charge Stock | Converted Transformer Oil |
|---|---|---|
| 1,1,1,-trichloroethane, wt. ppm | 5000 | 0.01 |
| dichloroethane | 0 | 884 |
| chloroethane | 0 | 0.05 |
| t-butyl chloride | 0 | 126 |

The resulting product transformer oil contained only 0.01 weight ppm 1,1,1-trichloroethane which demonstrated that the targeted chlorinated organic compound was essentially eliminated.

EXAMPLE 2

A mineral oil transformer oil was spiked with 2190 weight ppm of 1,1,1-trichloroethane (TCA) and charged to a reactor maintained at a temperature of 680° F. (360° C.) and a pressure of 5000 psig (3448 kPa gauge). This charge stock was reacted with a hydrogen gas stream introduced at a rate of 2500 standard cubic feet per barrel (SCFB) (421 normal $m^3/m^3$) and a liquid hourly space velocity (LHSV) of 3. The reactor was packed with #9 size quarts chips which are known to be free of catalytic activity for hydrogenation activity. The reactor effluent was cooled and mixed with a stream of 2% potassium hydroxide solution. The hydrocarbon product was analyzed and found to contain 0.030 weight ppm TCA which represented a conversion of 99.999% of the TCA present in the charge stock. This high conversion demonstrates that the hydrothermal reaction proceeds very rapidly at these conditions.

EXAMPLE 3

A pure stream of 1,1,1-trichloroethane (TCA) was charged to the reactor described in Example 2 at a liquid hourly space velocity (LHSV) of 1 and other operating conditions similar to those used in Example 2 with no sign of significant conversion of TCA. The reactor temperature profile was flat which indicated that the exothermic reaction to convert TCA and form hydrogen chloride was not occurring. Moreover, no production of ethane was observed in the gas phase. It was therefore clear from these observations that very little, if any, conversion of the TCA occurred during this experiment despite the lower charge rate (higher space velocity) relative to Example 2.

EXAMPLE 4

A pure stream of TCA was charged to a reactor containing a hydrogenation catalyst containing nickel and molybdenum on alumina at operating conditions including a liquid hourly space velocity of 0.5, a pressure of 500 psig (3448 kPa gauge) and a temperature of 608° F. (320° C.). No exotherm was observed in this experiment indicating little, if any, conversion of the TCA even in the presence of a catalyst.

EXAMPLE 5

A 3 weight percent solution of TCA in normal heptane was charged to a reactor containing another batch of catalyst as described in Example 4 at operating conditions including a liquid hourly space velocity of 10, a pressure of 500 psig (3448 kPa gauge) and a temperature of 608° F. (320° C.). Initially, this experiment demonstrated that the recovered hydrocarbon product contained 0.003 ppm TCA but the catalyst stability was poor and the conversion of TCA deteriorated in a relatively short period of time.

EXAMPLE 6

A mineral oil transformer oil was spiked with 50 weight percent 1,1,1-trichloroethane (TCA) and charged to a reactor containing another batch of catalyst as described in Example 4 at operating conditions including a liquid hourly space velocity of 1, a pressure of 1500 psig (10,342 kPa gauge), a hydrogen circulation rate of 5000 SCFB (843 normal $m^3/m^3$) and a temperature of 662° F. (350° C.). The chlorine concentration in the oil was reduced from 40 weight percent to 33.1 weight percent (a reduction of only 17.2%) which is considered to be a very low conversion for a catalytic process.

From the above examples, it is noted that (1) the non-catalytic reaction proceeds rapidly for 2200 ppm TCA in mineral oil at 680° F. (360° C.), 2500 SCFB (421 normal $m^3/m^3$) hydrogen circulation and 500 psig (3448 kPa heptane at a temperature of 608° F. (320° C.) at 500 psig (3448 kPa gauge), and (3) the catalytic reaction does not readily occur using 50% TAC in mineral oil at conditions described in Example 6.

Therefore, we have discovered an improved, useful process for the non-catalytic conversion of a hydrocarbonaceous stream containing less than about 5 weight percent halogenated organic compounds.

The foregoing description, drawing and examples clearly illustrate the advantages encompassed by the process of the present invention and the benefits to be afforded with the use thereof.

We claim as our invention:

1. A non-catalytic process for the conversion of a hydrocarbonaceous stream containing less than about 5 weight percent halogenated organic compounds which process consists essentially of (a) reacting said hydrocarbonaceous stream in the presence of hydrogen in a reaction zone at reaction conditions including an elevated temperature selected to hydrogenate at least a portion of said halogenated organic compounds; and (b) recovering a converted hydrocarbonaceous product stream containing lower halogen content.

2. The process of claim 1 wherein said hydrocarbonaceous stream comprises hazardous hydrocarbonaceous compounds.

3. The process of claim 1 wherein said hydrocarbonaceous stream comprises chlorinated hydrocarbons.

4. The process of claim 1 wherein said reaction conditions include a pressure from about 10 psig (68.9 kPa gauge) to about 2000 psig (13790 kPa gauge), a temperature from about 350° F. (177° C.) to about 850° F. (454° C.) and a hydrogen circulation rate from 20 SCFB (3.4 normal $m^3/m^3$) to about 25,000 SCFB (4213 normal $m^3/m^3$).

5. A non-catalytic process for the conversion of a hydrocarbonaceous stream containing less than about 5 weight percent halogenated organic compounds which process consists essentially of (a) reacting said hydrocarbonaceous stream in the presence of hydrogen in a reaction zone at reaction conditions including an elevated temperature selected to hydrogenate at least a portion of said halogenated organic compounds;

(b) contacting the reaction zone effluent with an aqueous scrubbing solution; and (c) introducing a resulting admixture of said reaction zone effluent and said aqueous scrubbing solution into a separation zone to provide a hydrocarbonaceous product stream containing lower halogen content and a spent aqueous stream.

6. The process of claim 5 wherein said hydrocarbonaceous stream comprises hazardous hydrocarbonaceous compounds.

7. The process of claim 5 wherein said hydrocarbonaceous stream comprises chlorinated hydrocarbons.

8. The process of claim 5 wherein said reaction conditions include a pressure from about 10 psig (68.9 kPa gauge) to about 2000 psig (13790 kPa gauge), a temperature from about 350° F. (177° C.) to about 850° F. (454° C.) and a hydrogen circulation rate from 20 SCFB (3.4 normal $m^3/m^3$) to about 25,000 SCFB (4213 normal $m^3/m^3$).

9. The process of claim 5 wherein said aqueous scrubbing solution comprises an alkaline compound.

10. The process of claim 9 wherein said alkaline compound is sodium hydroxide, potassium hydroxide or calcium hydroxide.

* * * * *